US007236731B2

(12) United States Patent
Nishiwaki

(10) Patent No.: US 7,236,731 B2
(45) Date of Patent: Jun. 26, 2007

(54) IMAGE FORMING APPARATUS FOR A COLOR LASER PRINTER FOR TRANSFERRING A HIGHER TRANSFER EFFICIENCY ON A RECORDING SHEET ON THE UPSTREAM SIDE OF THE IMAGING FORMING PROCESS

(75) Inventor: Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 10/953,336

(22) Filed: Sep. 30, 2004

(65) Prior Publication Data

US 2005/0069352 A1 Mar. 31, 2005

(30) Foreign Application Priority Data

Sep. 30, 2003 (JP) ..... 2003-339669

(51) Int. Cl.
*G03G 15/01* (2006.01)

(52) U.S. Cl. ..... 399/299; 399/66

(58) Field of Classification Search ..... 399/130, 399/149, 150, 297, 298, 299, 302, 308, 66
See application file for complete search history.

(56) References Cited

U.S. PATENT DOCUMENTS 5,469,248 A * 11/1995 Fujiwara et al. ..... 399/314
5,523,849 A * 6/1996 Jamzadeh ..... 358/1.9
5,659,857 A * 8/1997 Yamazaki et al. ..... 399/252
6,445,899 B2 9/2002 Sato
6,904,255 B2 * 6/2005 Kera et al. ..... 399/299
6,922,542 B2 * 7/2005 Mizuno et al. ..... 399/302
6,954,609 B2 * 10/2005 Ito ..... 399/353

FOREIGN PATENT DOCUMENTS

| | | |
|---|---|---|
| JP | A 09-319179 | 12/1997 |
| JP | A 11-231604 | 8/1999 |
| JP | A 2001-166556 | 6/2001 |
| JP | A 2001-183889 | 7/2001 |
| JP | A 2002-082477 | 3/2002 |
| JP | A 2002-082504 | 3/2002 |
| JP | A 2002-357939 | 12/2002 |

OTHER PUBLICATIONS

Yanagida et al., "Polymerized Toner/Functional Control of Micron-Size Particles," *Kobunshi Ronbun*, vol. 57, No. 6, pp. 336-345 (2000).

* cited by examiner

*Primary Examiner*—Hoan Tran
(74) *Attorney, Agent, or Firm*—Oliff & Berridge PLC

(57) ABSTRACT

An image forming apparatus includes developing devices, each of which contains a developing agent of a single color therein; a photosensitive member; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically. A transfer bias for transfer developing agent images from the photosensitive member to the image receiver member is set lower for the first developing agent image that is transferred than a transfer bias for transferring a second developing agent image.

24 Claims, 2 Drawing Sheets

IMAGE FORMING APPARATUS FOR A COLOR LASER PRINTER FOR TRANSFERRING A HIGHER TRANSFER EFFICIENCY ON A RECORDING SHEET ON THE UPSTREAM SIDE OF THE IMAGING FORMING PROCESS

INCORPORATION BY REFERENCE

This application claims priority from Japanese Patent Application No. 2003-339669, filed on Sep. 30, 2003, the contents of which are incorporated by reference thereto in their entirety herein.

BACKGROUND OF THE INVENTION

1. Field of Invention

The invention relates to an image forming apparatus that forms multi-color developing agent images by transferring and overlaying developing agent images of each color sequentially from a photosensitive member to an image receiver member 2. Description of Related Art There exists image forming apparatuses that form a color image (i.e., a color laser printer). Typically, in a color laser printer, a plurality of color toners, which are constituents of a color image, are used to form a toner image of each color on a photosensitive drum. The toner image of each color is electrically transferred and successively overlaid on an image receiver member such as a sheet of paper and an intermediate transfer belt Thereby, a multi color toner image is formed on the image receiver member. Japanese Patent Application No. 2001-166556 discloses a tandem color laser printer which has a plurality of process units that include a plurality of colors.

SUMMARY OF THE INVENTION

In such a laser printer, the toner images arc sequentially transferred and overlaid one over the other on an image receiver member. During the process, however, when a toner image is transferred onto the image receiver member, at a position where a toner image of a different color has been already transferred, the amount of electrostatic charge in the toner image that has already been transferred on the image receiver member will increase. A problem thus exists in that the amount of electrostatic charge of the toner image increases.

As the amount of the electrostatic charge of the toner image increases, a toner image of a different color is less prone to being transferred when the toner image is transferred from the surface of the photosensitive drum to the a toner image of another color formed already on the image receiver member, and the Tone on the image receiver member is apt to be transferred onto the photosensitive drum instead. As a result, the quality of the toner image on the image receiver member deteriorates.

The invention thus allows an image forming apparatus to reduce an increment in an amount of electrostatic charge of a developing agent image transferred on an image receiver member.

According to an exemplary aspect of the invention, an image forming apparatus includes a plurality of developing devices, each of which contains a developing agent of a single color therein; a photosensitive member that rotates in a peripheral direction; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically. A developing agent image formed of developing agent having a higher transfer efficiency is transferred earlier than a developing agent image formed of developing agent having a lower transfer efficiency onto the image receiver member. A transfer bias for transferring the developing agent images from the photosensitive member to the image receiver member is set lower for the developing agent image formed of the developing agent having the higher transfer efficiency.

According to another exemplary aspect of the invention, an image forming apparatus includes a plurality of developing devices, each of which contains a developing agent of a single color therein; a photosensitive member that rotates in a peripheral direction; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contact the photosensitive member and receives the developing agent images of each color formed on the photosensitive member sequentially and electrically. A developing agent image formed of a developing agent having a higher flowability is transferred earlier than a developing agent image formed of a developing agent having a lower flowability onto the image receiver member. A transfer bias for transferring the developing agent images from the photosensitive member to the image receiver member is set lower for the developing agent image formed of the developing agent having the higher flowability.

According to another exemplary aspect of the invention, an image forming apparatus includes a plurality of developing devices, each of which contains a developing agent of a single color therein; a photosensitive member that rotates in a peripheral direction; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically. A developing agent image to be transferred first to the image receiver member is formed of a developing agent whose transfer efficiency is higher than that of a developing agent used for a developing agent image to be transferred last. A transfer bias for transferring the developing agent image to be transferred first on the image receiver member is set lower than a transfer bias for transferring the developing agent image to be transferred last on the image receiver member According to another exemplary aspect of the invention, an image forming apparatus includes a plurality of developing devices, each of which contains a developing agent of a single color therein; a photosensitive member that rotates in a peripheral direction; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically. A developing agent image to be transferred first to the image receiver member is formed of a developing agent whose flowability is higher than that of a developing agent used for a developing agent image to be transferred last. A transfer bias for transferring the developing agent image to be transferred first on the image receiver member is set lower than a transfer bias for transferring the developing agent image to be transferred last on the image receiver member.

According to another exemplary aspect of the invention, an image forming apparatus includes a plurality of developing devices, each of which contains a developing agent of a single color therein; a photosensitive member that rotates in a peripheral direction; a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically. A transfer bias for transferring developing agent images from the photosensitive member to the image receiver member is set lower for the first developing agent image that is transferred than a transfer bias for transferring a second developing agent image.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
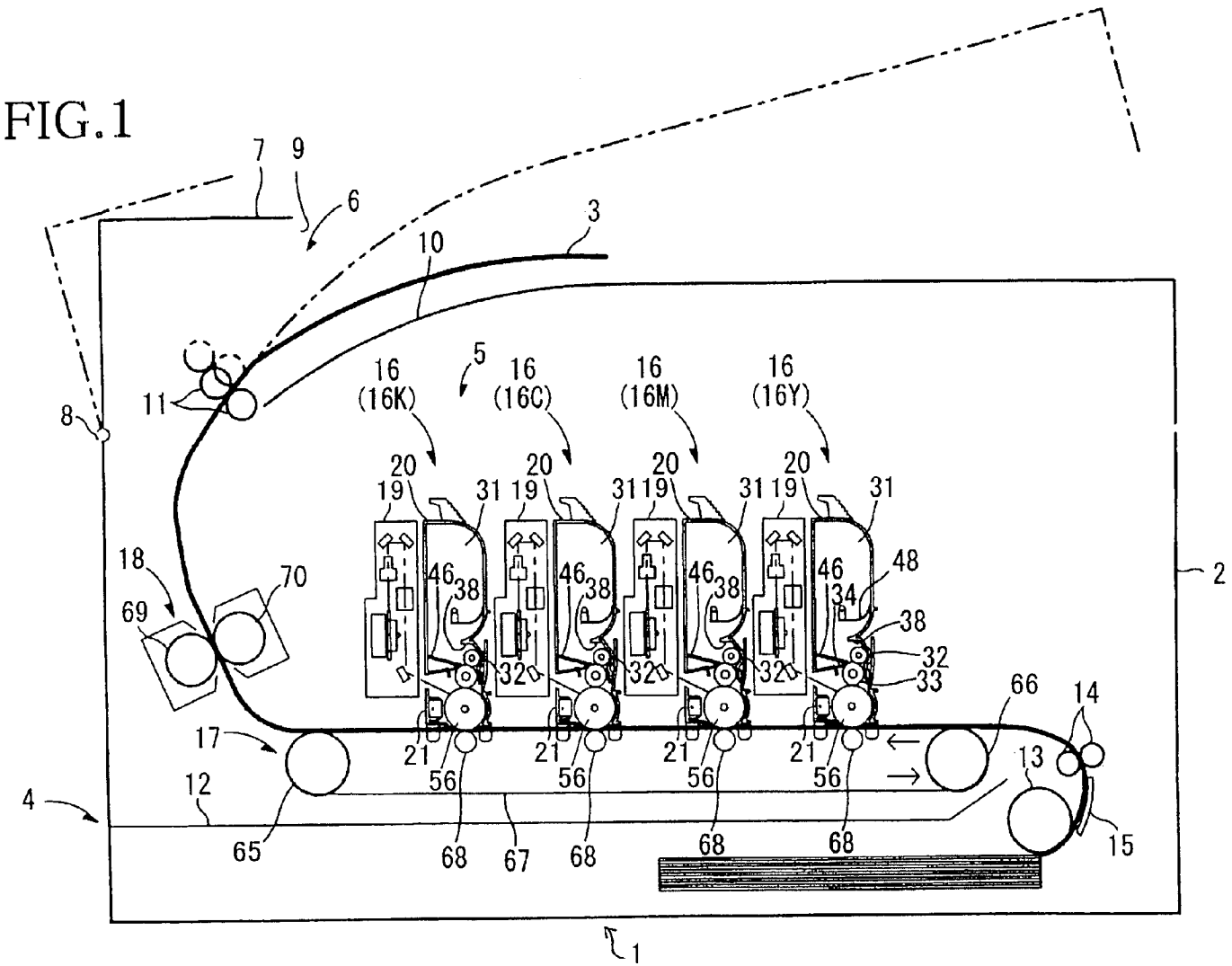
FIG. 1 is a side sectional view of essential parts of a color laser printer as an example of image forming apparatus according to an embodiment of the invention.

An embodiment of the invention will be described in detail with reference to the accompanying drawings. In FIG. 1, the color laser printer 1 is a tandem color laser printer in which four process units 16 are arranged in tandem with each other in a horizontal direction. The color laser printer 1 includes, in a main casing 2, a sheet feeding unit 4 that supplies a sheet 3, an image forming part 5 that performs image formation on the sheet 3 fed therein, and a sheet ejection part 6 that ejects the sheet 3 on which the image is formed.

The main casing 2 has a rectangular box shape in a side sectional view. The main casing 2 is structured so as to open at an upper side, and covered with a top cover 7 at the upper side. The top cover 7 is supported at a rear side of the main casing 2 (in the following description, the left side in FIG. 1 is regarded as the rear side and the right side as a front side) rotatably about a hinge 8 and provided openably (phantom line) and closably (solid line) to the main casing 2.

The top cover 7 includes a sheet discharge slot 9 that discharges the sheet 3, a sheet discharge tray 10 that recesses deeper toward the sheet discharge slot 9, and ejection rollers 11 provided at a rear end portion of the sheet discharge tray 10 in the sheet discharge slot 9. The sheet discharge slot 9, the sheet discharge tray 10, and the ejection rollers 11 are moved integrally with the top cover 7 when the top cover 7 is opened and closed.

The sheet feeding unit 4 is provided at a bottom portion in the main casing 2, and includes a sheet supply tray 12, a sheet supply roller 13, conveying rollers 14, and a guide member 15. The sheet supply tray 12 is detachably attached to the main casing 2 from the front side in a horizontal direction. The sheet supply roller 13 and the guide roller 15 are attached to an upper portion of the sheet supply tray 12 at one end (at the front side). The conveying rollers 14 are provided at a downstream side from the sheet supply roller 13 in a sheet feed direction and attached to the main casing 2.

In the sheet supply tray 12, sheets 3 are stacked from which an uppermost sheet 3 is supplied, one by one, toward the conveying rollers 14 upon the rotation of the sheet supply roller 13. The sheet 3 is conveyed from the conveying rollers 14 to a transfer position between a conveyor belt 67 and each photosensitive drum 56.

The guide member 15 is provided between the sheet supply roller 13 and the conveying rollers 14 in a vertical direction. The sheet 3 supplied by the sheet supply roller 13 is guided to the conveying rollers 14 by the guide member 15, and conveyed from the conveying rollers 14 toward the transfer position between the conveyor belt 67 and each photosensitive drum 56 successively positioned rearward.

The image forming part 5 includes the process units 16, a transfer part 17, and a fix part 18. The process units 16 are provided in accordance with each toner color of a plurality of toner colors, which are color image components. That is, in the color laser printer 1, the process units 16 are a yellow process unit 16Y, a magenta process unit 16M, a cyan process unit 16C, and a black process unit 16K The process units 16 are sequentially disposed at a specified distance away so as to overlap, or be aligned with, each other in the horizontal direction.

Each process unit 16 is identical in shape, structure and operation, and includes a scanner unit 19, a developing unit 20 as a developing device, and a photosensitive drab unit 21.

Each developing unit 20 is detachably attached to the main casing 2, and includes a toner chamber 31, a supply roller 32, a developing roller 33, and a layer thickness regulating blade 34, in a development casing 30.

Figure 2:
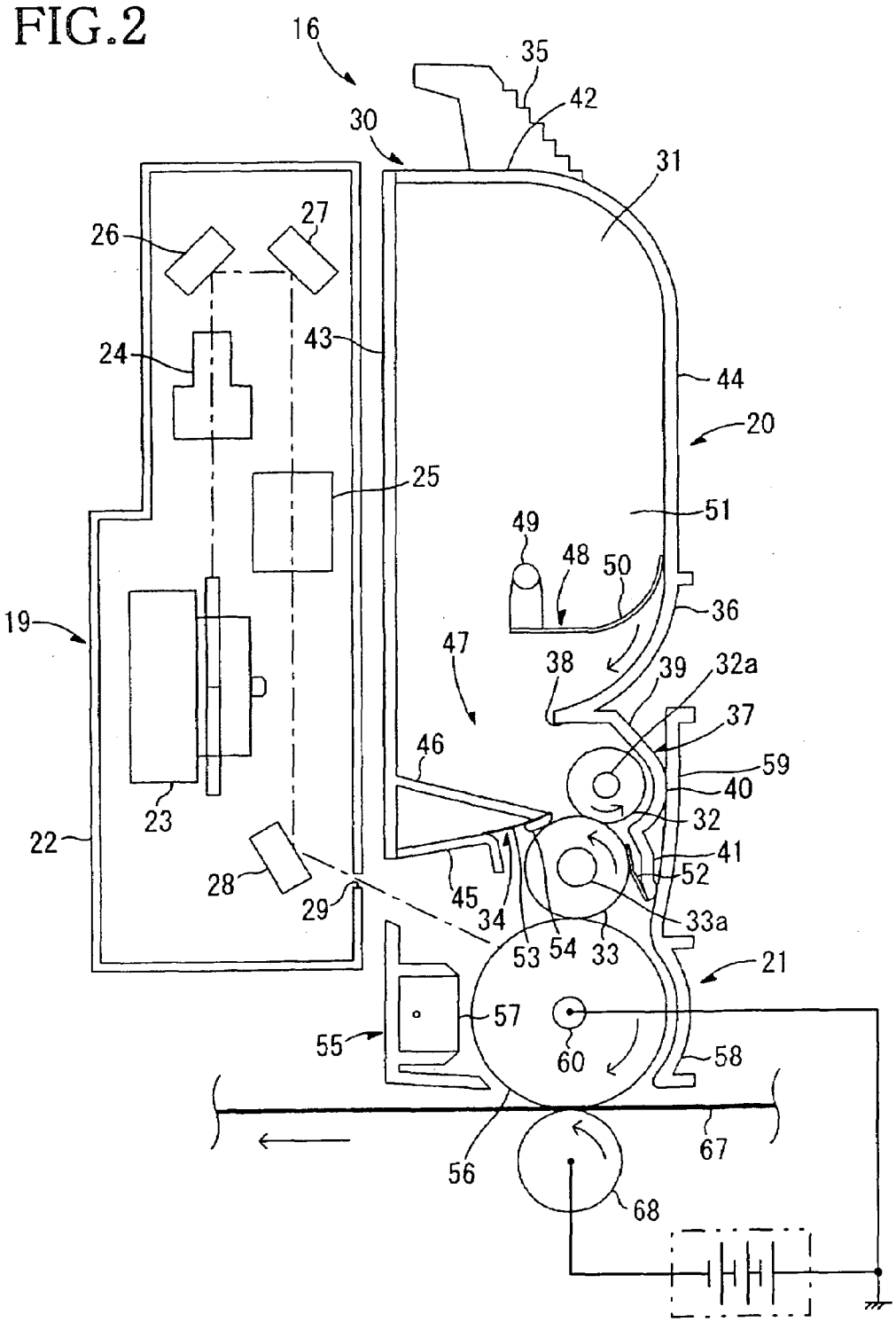
FIG. 2 is an enlarged side sectional view of essential parts of a process unit in FIG. 1.

As shown in FIG. 2, the development casing 30 has a substantially rectangular box shape in a side sectional view, and is openable at a lower side. A holding part 35 for holding the development casing 30 is provided on a top wall 42. The holding part 35 is formed to protrude upward from the top wall 42 of the development casing 30 in the form of substantially a triangle when viewed in a side sectional view. A front face of the holding part 35 is formed in saw-toothed shape so to enable a secure grip by hand.

A rear wall 43 of the development casing 30 is formed substantially in a plane that is parallel to a front wall of the scanner casing 22, also formed in a plane.

A front wall 44 of the development casing 30 is formed, in a side sectional view, such that a corner portion at its upper end is curved continuously to join with the top wall 42. A middle of the front wall 44 with respect to a top and bottom direction thereof is formed substantially parallel to the rear wall 43. A lower end portion of the front wall 44 is an agitator facing wall 36, that is a portion facing an agitator 48 provided in the toner chamber 31, and is formed in a curve (downward and rearward) as see in a side sectional view along a rotation path of the agitator 48.

A cover wall 37 that covers the supply roller 32 and the developing roller 33 is formed at a lower location than the agitator facing wall 36 and is in the front wall 44 of the development casing 30.

The cover wall 37 is folded continuously from the rear end portion of the agitator facing wall 36 which extends in a curve rearward in the side sectional view. The cover wall 37 is made up of a supply roller upper wall portion 38, a supply roller inclined wall portion 39, a supply roller front-side cover wall portion 40, and a developing roller front-side cover wall portion 41, which are formed integrally. The supply roller upper wall portion 38 extends frontward in a horizontal direction. The supply roller inclined wall portion 39 continues from the front end portion of the supply roller upper wall portion 38, and extends frontward and downward. The supply roller front-side cover wall portion 40 continues from the front end portion of the supply roller inclined wall portion 39 and extends in a curve, in the side sectional view, along an outer surface of the supply roller 32 (in a curve where the top and bottom ends are disposed rearward and the middle is disposed frontward in the side sectional view). The developing roller front-side cover wall portion 41 is folded continuously from the rear end portion of the supply roller front-side cover wall portion 40, that extends in a curve rearward, and extends frontward and rearward.

A blade support wall 45 extends upwardly from the lower end portion of the rear wall 43 of the development casing 30 toward the front, and is joined to the rear wall 43. A free end of the blade support wall 45 is disposed so as to face the rear side surface of the developing roller 33.

A guide wall 46 is provided near the lower end portion of the rear wall 43 of the development casing 30 in such a manner that it extends slightly obliquely downward toward the font and covers the blade support wall 45 from above. More specifically, the guide wall 46 extends from the rear wall surface 43, at the rear end portion, such that the front end portion is located above the developing roller 33 and disposed near a position where the developing roller 33 and the layer thickness regulating blade 34 face each other. Thereby, the guide wall 46 is disposed such that its front end portion, close to the developing roller 33, inclines downward and its rear end portion far from the developing roller 33 inclines upward, respectively relative to a horizontal direction, while covering the blade support wall 45 and the layer thickness regulating blade 34 from above.

The guide wall 46 is a flat surface and is provided across the entire width of the development casing 30 (in an axial direction of a photosensitive drum 56).

The development casing 30 is made of a polyethylene resin, for example. The rear wall 43 and the guide wall 46 are formed integrally. The top wall 42, the front wall 44 (including the agitator facing wall 36 and the cover wall 37), the blade support wall 45 and both side walls 51 are formed integrally. Both side walls 51 extend oppositely from both sides of the front wall 44, with respect to its width, to the rear wall 43. A rear end portion of the top wall $^{42}$ and rear end portions of both side walls 51 are welded to the upper end portion and both side portions of the rear wall 43, respectively. A rear end portion of the blade support wall 45 is welded to a lower end portion of the rear wall 43. The development casing 30 is thus formed.

In the development casing 30, an upper internal space from the top wall 42 to the lower end portion of the agitator facing wall 36 (that is, the rear end portion of the agitator facing wall 36 that continues to the supply roller upper wall portion 38 by the fold) is structured as the toner chamber 31. An internal space thereunder, that is a lower internal space from the supply roller upper wall portion 38 to the lower end portion of the developing roller front-side cover wall portion 41 in a vertical direction, is structured as the developing chamber 47 that includes the supply roller 32, the developing roller 33, and the layer thickness regulating blade 34 therein.

The toner chamber 31 contains nonmagnetic single-component polymerized toner of a color, that is to be positively charged, as a developing agent In the toner chamber 31, each process unit 16 includes a color loner. The yellow process unit 16Y includes yellow toner, the magenta process unit 16M includes magenta toner, the cyan process unit 16C includes cyan toner, and the black process unit 16K includes black toner.

Toner of each color is a polymerized toner having substantially spherical particles obtained through copolymerization. The polymerized toner has binder resin as the main ingredient, which is obtained through copolymerization of styrene-based monomers, such as styrene, and acryl-based monomers, such as acrylic acid, alkyl (C1–C4) acrylate, and alkyl (C1–C4) methacrylate, using a known polymerization method, such as suspension polymerization. A coloring agent, a charge control agent, and wax are added to the polymerized toner to form toner base particles. Additives are also added to the polymerized toner to improve flowability.

As a coloring agent, each coloring agent of yellow, magenta, cyan, and black is formulated. As a charge control agent, combined is a charge control agent obtained through copolymerization of ion-based monomers having an ionized functional group, such as ammonium salt, and monomers Cat can be copolymerized with ion-based monomers, such as styrene-based monomers and acryl-based monomers. As additives, there are silica, aluminum oxide, titanium oxide, strontium titanate, ceric oxide, and magnesium oxide. The additives are inorganic powder such as metallic oxide powder, carbonized powder, and metal salt powder. The metallic oxide powder is made of aluminum oxide, titanium oxide, strontium titanate, ceric oxide, and magnesium oxide.

The agitator 48 for agitating toner is provided in a lower part of the toner chamber 31. The agitator 48 includes a rotary shaft 49 rotatably supported at both side walls 51, and an agitating member 50 made of a film extending from the rotary shaft 49 in a radial direction.

In the aviator 48, power from a motor (not shown) is inputted to the rotary shaft 49, the rotary shaft 49 is rotated, and Thus, the agitating member 50 is rotated in the direction of the arrow (clockwise). Through the agitation of the agitating member 50, toner in the toner chamber 31 flows from the rear end portion of the agitator facing wall 36 to the developing chamber 47.

The supply roller 32 is provided along the supply roller front-side cover wall portion 40 formed in a curve under the supply roller upper wall portion 38 at the front upper side of the developing chamber 47.

The supply roller 32 is made by covering a metallic roller shaft 32*a* with a roller portion made of a conductive sponge. The outside diameter of the supply roller 32 is formed smaller than that of the developing roller 33. The roller shaft 32*a* of the supply roller 32 is rotatably supported by both side walls 51 of the development casing 30, to which power is transmitted from the motor (not shown) during development.

The supply roller 32 is rotated in the direction of the arrow (counterclockwise) so as to rotate in the direction opposite to the developing roller 33 at a nip portion where the supply roller 32 contacts the developing roller 33.

The developing roller 33 is disposed facing the supply roller 32 under the supply roller 32 at the front lower side in the developing chamber 47, in such a manner as to press against the supply roller 32. The developing roller 33 is disposed so as to face the developing roller front-side cover wall portion 41 at the front side, and the blade support wall 45 at the rear side. The developing roller 33 is arranged such that the lower side surface of the developing roller 33 is exposed from the development casing 30.

The developing roller 33 is made by covering the roller shaft 33*a* of metal with a roller portion made of elastic member, such as a conductive rubber material. More specifically, the roller portion of the developing roller 33 is provided by a two-tier structure of an elastic roller part and a coat layer that covers the surface of the roller part. The elastic roller part is made of conductive rubber, which includes carbon particles, such as urea rubber, silicone rubber, and ethylene-propylene-diene-terpolymer (EPDM) rubber. The coat layer is made of urethane rubber, urethane resin, polyimide resin or other materials as a main intergradient. The outside diameter of the developing roller 33 is formed smaller than that of the photosensitive drum 56 (the outside diameter of the developing roller 33 is approximately 20 mm in the embodiment). The roller shaft 33*a* of the developing roller 33 is rotatably supported by both side walls 51 of the development easing 30, and power from the motor (not shown) is transmitted to the roller shaft 33*a*. The developing roller 33 is rotated in the direction of the arrow (counterclockwise), so as to rotate in the same direction as the photosensitive drum 56 at a nip portion where the developing roller 33 makes contact with the photosensitive drum 56. During developing, a developing bias is applied to the roller shaft 33*a* of the developing roller 33 from a power supply (not shown). In the embodiment, the developing bias to be applied is set to approximately +500V.

A film member 52 is provided at the developing roller front-side cover wall portion 41 and pressed against the front-side surface of the developing roller 33. The film member 52 prevents toner leakage from a gap between the front-side surface of the developing roller 33 and the developing roller front-side cover wall portion 41.

The layer thickness regulating blade 34 is provided across the entire width of the development casing 30, and disposed toward a downstream side in the rotation direction of the developing roller 33 from the position where the developing roller 33 and the supply roller 32 face each other. The layer thickness regulating blade 34 includes a blade body 53 made of a metal plate spring member and a pressing portion 54 having a generally semicircular shape in cross section, provided at a free end of the blade body 53, and made of insulative silicone rubber.

The blade body 53 is joined on the top surface of the blade support wall 45 at its proximal end, and disposed such that the free end of the blade body 53 extends front from the blade support wall 45 and faces the upper-side surface of the developing roller 33.

A sponge material (not shown) is provided on the top surface (toward the guide wall 46) at the free end of the blade body 53, and the free end of the guide wall 46 makes contact with the sponge material from above. This structure prevents toner, which is scraped by the developing roller 33, from entering between the guide wall 46 and the layer thickness regulating blade 34 and accumulating on the upper side of the layer thickness regulating blade 34.

The pressing portion 54 is provided on the bottom surface at the free end of the blade body 53, and is pressed against the upper-side surface of the developing roller 33 by elasticity of the blade body 53.

In the above-described arrangement, the upper-side surface of the developing roller 33 makes contact with the supply roller 32 at the front side and the pressing portion 54 of the layer thickness regulating blade 34 at the rear side at a distance from the nip portion formed with the supply roller 32. Thereby, the upper-side surface of the developing roller 33 makes contact with toner at a clearance between the nip portion with the supply roller 32 and the contact part with the pressing portion 54.

In addition, the supply roller upper wall portion 38, the supply roller 32, and the developing roller 33 air disposed overlapping each other in the vertical direction. More specifically, in the vertical direction, the supply roller 32 is entirely covered with the supply roller upper wall portion 38, while the developing roller 33 is disposed such that the rear-side surface of the developing roller 33 is exposed from the rear end of the supply roller upper wall portion 38.

When toner stored in the toner chamber 31 flows from the rear end portion of the agitator facing wall 36 toward the developing chamber 47 by the agitation of the agitating member 50, the toner is supplied to the developing roller 33 through the rotation of the supply roller 32 while being positively charged between the supply roller 32 and the developing roller 33. At this time, as the supply roller 32 and the developing roller 33 rotate in opposite directions at the nip portion therebetween, the toner supplied from the supply roller 32 to the developing roller 33 is efficiently charged and excellent development is accomplished. Further, toner that was not transferred to the photosensitive drum 56 and has remained on the developing roller 33 can be excellently removed by the supply roller 32.

When the toner supplied to the developing roller 33 and charged by friction goes in between the pressing portion 54 of the layer thickness regulating blade 34 and the developing roller 33 along with the rotation of the developing roller 33, it is uniformly regulated to a specified thickness and carried on the developing roller 33.

Each photosensitive drum unit 21 is detachably attached to the main casing 2, and includes a photosensitive drum 56 and a scorotron charger 57 in a drum casing 55. The photosensitive drum 56 is disposed facing the developing roller 33.

The drum casing 55 is integrally formed with a drum storing part 58, and a backup plate portion 59. The drum storing part 58 is a substantially rectangular frame having an opening therethrough in a top to bottom direction, and the backup plate portion 59 extends upward from the drum storing part 58 and receives the cover wall 37 of the development casting 30.

The photosensitive drum 56 is constructed from a metal cylindrical tube made of aluminum, which is coated with a photosensitive layer of an organic photosensitive member having polycarbonate as the main ingredient. The outside diameter of the photosensitive drum 56 is formed larger than that of the developing roller 33. The photosensitive drum 56 is rotatably supported by both side walls of the drum storing part 58 via a support shaft 60. Power is transmitted from a motor (not shown) to the photosensitive drum 56 via a gear mechanism provided at one side thereof. The photosensitive drum 56 is rotated in the direction of the arrow (clockwise) so as to rotate in the same direction as the conveyor belt 67 at a nip portion where the photosensitive drum 56 makes contact with the conveyor belt 67.

The scorotron charger 57 is fixed to the rear wall of the drum storing part 58 at a distance from the rear side of photosensitive drum 56. The scorotron charger 57 is of a positive charge type and generates a corona discharge from a charging wire, such as a tungsten wire. The scorotron charger 57 is disposed so as to positively and uniformly charge the surface of the photosensitive drum 56 through application of a voltage from a power supply (not shown). In the embodiment, the charging potential at the surface of the photosensitive drum 56 after charging is set to approximately +700V.

Each scanner unit 19 is disposed at a specified distance away from the conveyor belt 67 in a vertical direction, and is fixed to the main casing 2. Each scanner unit 19 includes a laser emitting portion (not shown), a polygon mirror 23, two lenses 24, 25, and three reflecting mirrors 26, 27, 28, in a scanner casing 22.

The scanner casing 22 has a substantially rectangular box shape in a side sectional view, and is fixed to the main casing 2 with its longitudinal direction orientated in the vertical direction. A window 29, through which a laser beam is emitted is formed on a wall of the scanner casing 2 facing the photosensitive drum unit 21.

In the scanner unit 19, a laser beam emitted from the laser emitting portion, based on print data, sequentially passes through or reflects from the polygons mirror 23, the lens 24, the reflecting mirror 26, the reflecting mirror 27, the lens 25, and the reflecting mirror 28 in order, and is emitted from the window 29, as shown by a dot dashed line of FIG. 2. The laser beam emitted from the window 29 is directed to the photosensitive drum 56 by high speed scanning. Thus, the surface of the photosensitive drum 56 uniformly and positively charged by the scorotron charger 57 is exposed to the laser beam, thereby an electrical latent image is formed based on predetermined image data. In the embodiment, the potential at the surface of the photosensitive drum 56 after exposure to the laser beam is set to approximately +150V.

The transfer part 17 is disposed opposite each developing unit 20 via each photosensitive drum 56 in the main casing 2, as shown in FIG. 1. The transfer part 17 includes a drive roller 65, a driven roller 66, the conveyor belt 67, and transfer rollers 68. The transfer rollers 68 and the photosensitive drums 56 are arranged to face each other.

The driven roller 66 is disposed further forward than the photosensitive drum 56 in the yellow process unit 16Y. The drive roller 65 is disposed fiber rearward them the photosensitive drum 56 in the black process unit 16K.

The conveyor belt 67 is an endless belt and is formed of a conductive resin, such as polycarbonate and polyimide, in which conductive particles, for example, carbon particles, are dispersed. The conveyor belt 67 is stretched between the drive roller 65 and the driven roller 66. The conveyor belt 67 is disposed so as to make contact with the photosensitive drum 56 of each process unit 16 at an outer contact surface.

When the drive roller 65 is driven, the driven roller 66 is rotated, the conveyor belt 67 is moved around between the drive roller 65 and the driven roller 66 in the counterclockwise direction so as to rotate in the same direction as the photosensitive drum 56 of each process unit 16 at the contact surface.

The transfer rollers 68 are provided inside the conveyor belt 67 so as to face the respective photosensitive drums 56 of each process unit 16 via the conveyor belt 67. The transfer rollers 68 are made by covering metal roller shafts with roller portions formed of elastic member, such as conductive rubber material. The transfer rollers 68 are provided rotatable in the counterclockwise direction so as to rotate in the same direction as the conveyor belt 67 at the contact surface between the transfer rollers 68 and the conveyor belt 67. During image transfer, a predetermined voltage is applied in a direction where a toner image held on the photosensitive drum 56 is transferred onto a sheet 3, and an appropriate transfer bias is applied inbetween the transfer rollers 68 and the photosensitive drum 56 by the constant current control (refer to FIG. 2).

The fixing part 18 is provided further rearward than the process units 16 and the transfer part 17 and at a downstream side with respect to the sheet feed direction. The fixing part 18 includes a heat roller 70 and a pressure roller 69. The heat roller 70 is made of a metal tube on which a release layer is formed, and includes a halogen lamp along its axial direction. The surface of the heat roller 70 is heated to a fixing temperate by the halogen lamp. The pressure roller 69 is provided so as to press against the heat roller 70.

The sheet ejection part 6 includes the sheet discharge slot 9, the sheet discharge tray 10, and the ejection rollers 11.

In the color laser printer 1, in order to improve the transfer efficiency of a toner image from the photosensitive drum 56 to the sheet 3, toner of each color whose flowability is highly adjusted (that is to say, toner of each color having high transfer efficiency) is used. Toner of each color includes different additives whose weight ratios are different (additives for improving the flowability) in order to adjust the difference in electrostatic charge characteristics of different coloring materials to be mixed in toner. In general when the weight ratio of additives to toner is higher, the flowability is higher. To obtain sufficient flowability of toner, a weight percent (wt %) of additives to toner is 0.03 to 1.5 wt %, and preferably 1.0 to 1.5 wt %.

In the embodiment, the flowability of toner is different according to toner colors, and the ranking of toner flowability from highest to lowest is yellow, magenta, cyan, and black (yellow>magenta>cyan>black). That is, the percent by weight of additive to yellow toner is the highest, and the percent by weight of additive to black toner is the lowest. In the color laser printer 1, the process units 16 are arranged in such a manner that a developing device 20 containing toner whose flowability is higher is disposed on a more upstream side with respect to the direction where the sheet 3 is conveyed. Thus, the developing unit 20 containing yellow toner is disposed on the most upstream side with respect to the direction where the sheet 3 is conveyed, and the developing units 20 each containing magenta toner, cyan toner, and black toner in this order are disposed toward the downstream side.

As a result, toner having the highest flowability, namely, the yellow toner is transferred onto the sheet 3 first, and then the magenta, cyan, and black toners are transferred onto the sheet 3 in this order.

In the color laser printer 1, to transfer the toner image on the photosensitive don 56 onto the sheet 3, the transfer bias to be applied in between each transfer roller 68 and the photosensitive drum 56 is set low insofar as an excellent toner image can be obtained. The transfer bias can be set lower as the flowability of the toner to be used for the toner image to be transferred onto the sheet 3 is higher (that is, the transfer efficiency is higher). Thus, in the color laser printer 1, the transfer bias is set lower when a toner image whose toner has higher flowability is transferred. As a result, the transfer rollers 68 disposed more upstream with respect to the direction where the sheet 3 is conveyed are designed to receive a lower transfer bias.

The transfer bias being "low" does not mean that the potential to be applied to the transfer roller 68 is low but that the magnitude of the transfer bias to be applied in between the transfer roller 68 and the photosensitive drum 56 is smaller. In other words, it means that a weaker transfer bias acts. For example, when a transfer bias of the constant current is applied by the constant current control, the smaller the current value is, the smaller (weaker) the transfer bias is. Contrarily, the greater the current value is, the greater (stronger) the transfer bias is.

Next, a printing operation of the color laser printer 1 will be described. When the photosensitive drum 56 of each process unit 16 is rotated in the rotational direction, the surface of the photosensitive drum 56 is uniformly, positively charged by the scorotron charger 57. Then, with the rotation of the photosensitive drum 56, a laser beam from the scanner unit 19 is scanned at a high speed on the surface of the photosensitive drum 56, thereby forming an electrostatic latent image thereon based on image data. Then, positively charged toner carried on the developing roller 33 is electrically moved to the electrostatic latent image formed on the surface of the photosensitive drum 56, where the potential has become low due to exposure to the laser beam. As a result, the latent image becomes visible and a reversal takes place. Thus, toner image of each color is formed on the photosensitive drum 56.

On the other hand, the sheet 3, supplied from the sheet feeding unit 4, is conveyed by the conveying rollers 14, passing between the conveyor belt 67, which is moved by the drive roller 65 and the driven roller 66, and the photosensitive drum 56 of each process unit 16. While the sheet 3 passes wherebetween, toner images of each color formed on the photosensitive drums 56 of each process unit 16 are sequentially transferred to the sheet 3 so as to overlap each other. Thereby a multi-color toner image is formed on the sheet 3.

Specifically, the sheet 3 is conveyed to the photosensitive drum 56 of the yellow process unit 16Y, and a yellow toner image formed on the photosensitive drum 56 of yellow process unit 16Y is transferred to the sheet 3.

The sheet 3 where the yellow toner image has been transferred is conveyed to the photosensitive drum 56 of the magenta process unit 16M, and a magenta toner image formed on the photosensitive drum 56 of the magenta process unit 16M is transferred to the sheet 3 where the yellow toner image has been already transferred and overlaid one over the other. At this time, he more the amount of electrostatic charge increases in the toner image already transferred on the sheet 3 (in this case, the yellow toner image), the greater the transfer bias.

Then, the sheet 3 where the magenta and yellow toner images have been transferred is conveyed to the photosensitive drum 56 of the cyan process unit 16C, and a cyan toner image formed on the photosensitive drum 56 of the cyan process unit 16C is transferred to the sheet 3 where the magenta and yellow toner images have been already transferred and overlaid one over the other. At this time, the greater the transfer bias is, the more the amount of electrostatic charge increases in the toner image already transferred on the sheet (in this case, the magenta and yellow toner images).

Subsequently, the sheet 3 where the cyan magenta and yellow toner images have been transferred is conveyed to the photosensitive drum 56 of the black process unit 16K, and a black toner image formed on the photosensitive drum 56 of the black process unit 16K is transferred to the sheet 3 where the cyan, magenta and yellow toner images have been already transferred and overlaid one over the other. At this time, the greater the transfer bias is, the more the amount of electrostatic charge increases in the toner image already transferred onto the sheet 3 (the cyan, magenta, and yellow toner images in this case).

In this way, the amount of electrostatic charge in the toner image on the sheet 3 increases when the sheet 3 passes through each photosensitive drum 56. Thus, the toner image transferred earlier has a greater amount of electrostatic charge. However, the color laser printer 1 is designed such that the transfer bias to be applied in between each transfer roller 58 and the corresponding photosensitive drum 56 is set low. Especially, the transfer bias is set lower for a transfer roller 68 disposed at a more upstream side with respect to the direction where the sheet 3 is conveyed. Thus, the increment in the amount of electrostatic charge of the toner image is kept minimum.

When forming such a color image, the color laser printer 1 is a tandem printer having the photosensitive drums 56 for each color, the toner images of each color can be formed at substantially the same speed as that for monochrome image formation, thereby obtaining rapid color image formation.

Toner, which was not transferred onto the sheet 3 and remains on the photosensitive drum 56, is collected by the developing roller 33 into the toner container 31 of the developing unit 20. In other words, toner remaining on the photosensitive drum 56 is charged by the scorotron charger 57, then irradiated with a laser beam from the scanner unit 19 thereby an electrostatic latent image is formed. However, the toner remaining in an unexposed area of the surface of the photosensitive drum 56 is electrically moved toward the developing roller 33, scraped off by the supply roller 32, and collected in the toner container 31. Thus, the laser printer 1 is designed to adopt the so-called cleaner-less method. In an exposed area of the surface of the photosensitive drum 56, the toner remaining and the toner moved from the developing roller 33 are adhered and transferred from the photosensitive drum 56 to the sheet 3 at the transfer position.

The toner image of multi-colors transferred onto the sheet 3 is fixed by heat while the sheet 3 passes between the heat roller 70 and the pressure roller 69 at the fixing unit Thus, the sheet 3 on which the image has been printed is ejected by the ejection rollers 11 from the sheet discharge slot 9 outside the main casing 2, and stacked on the sheet discharge tray 10.

In the color laser printer 1 of the embodiment, the scanner unit 19 functions as a latent image forming device of the invention, the developing unit 20 as a developer of the invention, and the photosensitive drum 56 as a photosensitive member of the invention.

The transfer efficiency means an amount of developing agent transferred from the photosensitive member to the image receiver member with respect to an amount of developing agent on the photosensitive member before transfer (that is, the amount of developing agent to be transferred on the image receiver member). The transfer efficiency is equal an amount of developing agent transferred divided by an amount of developing agent to be transferred. Thus, the higher the transfer efficiency is, the more preferably the developing agent can be transferred from the photosensitive member to the image receiver member. The transfer efficiency of the developing agent of each color can be compared by running a test on the developing agent of each color under the same conditions.

As described above, according to the color laser printer 1 of the embodiment, the increment in the amount of electrostatic charge of the toner image transferred onto the sheet 3 can be kept minimum. As a result, the transferability at the time when toner images are transferred and overlaid one over the other on the sheet 3 can be improved, and a reverse transfer of toner from the sheet 3 to the photosensitive drum 56 can be prevented.

Especially, in a printer adopting a cleaner-less developing method like the color laser printer 1, if toner is reversely transferred from the sheet 3 to the photosensitive drum 56, a toner of a color that is different from that stored in the toner container 31 of a developing unit 20 may be collected in the toner chamber 31, resulting in a mixture of toner colors. However, according to the color laser printer 1, a reversal can be prevented, and a mixture of toner colors is less prone to occur.

While the invention has been described with reference to the exemplary embodiment, it is to be understood that the invention is not restricted to the particular forms shown in the foregoing exemplary embodiment. Various modifications and alterations can be made thereto without departing from the scope of the invention.

For example, in the color laser printer 1 of the embodiment, the flowability of toner of each color is determined according to the weight ratio of additives to be added to toner, and is adjusted such as to become higher as the weight ratio of additives to the toner is higher. To improve the flowability of toner, there are various methods as shown below.

Toner usually includes various types of additives and each type of additive has a specific mean particle size. Of the specific mean particle sizes of the various types of additives included in the toner, the smallest specific mean particle size is preferably between 5 nm and 20 nm to improve the flowability. More preferably, the smallest specific mean particle size is smaller than or equal to 10 nm. As the ranking of toner flowability from highest to lowest is yellow, magenta, cyan, and black (yellow>magenta>cyan>black), the additive with the smallest specific mean particle size included in the yellow toner has a specific mean particle size that is smaller than that included in any of the other three color toners. The additive with the smallest specific mean particle size included in the magenta toner has a specific mean particle size that is smaller than that included in the cyan and black toner. The additive with the smallest specific mean particle size included in the in the cyan toner has a specific mean particle size that is smaller than that included in the black toner.

The toner flowability can be improved by setting the BET specific surface area of an additive with the smallest specific mean particle size included in the toner in the range 100 $m^2/g$ to 300 $m^2/g$. As the ranking of toner flowability from highest to lowest is yellow, magenta, cyan, and black (yellow>magenta>cyan>black), the BET specific surface area of an additive with the smallest specific mean particle size included in the yellow toner is greater than that included in any of the other three color toners. The BET specific surface area of the additive with the smallest specific mean particle size included in the magenta toner is greater than that included in the cyan and black toners. The BET specific surface area of the additive with the smallest specific mean particle size included in the cyan toner is greater than that included in black toner. The inventor of the invention reached a conclusion that the toner flowability is improved when an additive having the mean particle size of 10 nm and the BET specific surface area of 200 $m^2/g$ or an additive having the mean particle size of 8 nm and the BET specific surface area of 300 $m^2/g$ is used as the additive with the smallest specific mean particle size included in the yellow toner.

Toner base particle size is also related to the toner flowability. The mean particle size of toner base particles is preferably 3.5 μm to 10 μm, more preferably 5 μm to 10 μm. Within this range, the greater the particle size of the toner base particles is, the better the toner flowability will be. With an additive of which mean particle size is smaller than or equal to 3.5 μor greater than or equal to 10 μm preferable flowability cannot be obtained. As the ranking of toner flowability from highest to lowest is yellow, magenta, cyan, and black (yellow>magenta>cyan>black), the mean particle size of the toner base particles included in the yellow toner is greater than that included in any of the other three color toners. The mean particle size of the toner base particles included in the magenta toner is greater than that included in the cyan and black toners. The mean particle size of the toner base particles included in the cyan toner is greater than that included in the black toner. The inventor of the invention reached a conclusion that the toner flowability is improved when the mean particle size of the toner base particles included in the yellow toner is set as great as possible within the above rage, specifically set to 9.5 μm.

The particle size distribution on toner base particles is also related to the toner flowability. The particle size distribution on the toner base particle size is given by an index determined by the volume-average particle size (dv) divided by the number-average particle size (dp). When the index dv/dp is smaller than or equal to 1.3, better flowability can be obtained. As the ranking of toner flowability from highest to lowest is yellow, magenta, cyan, and black (yellow>magenta>cyan>black), the index dv/dp of the toner base particles included in the yellow toner is smaller than that included in any of the other three color toners. The index dv/dp of the toner base particles included in the magenta toner is smaller than that included in the cyan and black toners. The index dv/dp of the toner base particles included in the cyan toner is smaller than that included in the black toner. The inventor of the invention arrived at a conclusion that the index dv/dp of the toner base particles included in the black toner is smaller or equal to 1.2 and the index dv/dp of the toner base particles included in any of the other color toners is further smaller.

In addition, the roundness of a toner base particle is also related to the toner flowability. The roundness C of a toner base particle is found as follows:

$$C=4\pi S/L^2$$

where S is the projection area of a toner base particle and L is the perimeter of the toner base particle.

To obtain sufficient flowability, the roundness C of the toner base particle is preferably greater than or equal to 0.6 and smaller than or equal to 1.0. The toner flowability is higher when the roundness C is greater. However, it is known that the transfer efficiency of toner is reduced when the roundness C is smaller than or equal to 0.94. As the ranking of toner flowability from highest to lowest is yellow, magenta, cyan, and black (yellow> magenta>cyan>black), the mean roundness of toner base particles included in the yellow toner is greater than that included in any of the other three color toners. The mean roundness of toner base particles included in the magenta toner is greater than that included in the cyan and black toners. The mean roundness of toner base particles included in the cyan toner is greater than that included in the black toner. The inventor of the invention reached a conclusion that the toner flowability is increased and sufficient transfer efficiency is obtained when the mean roundness of the toner base particles is greater than or equal to 0.99 and smaller than or equal to 1.0.

The above description is made based on the tandem laser printer 1 of direct transfer type where transfer is performed on the sheet 3 directly from each photosensitive drum 56. However, the invention is not limited to this kind of printer. The invention may be applied to a tandem color laser printer of intermediate transfer type where a toner image of each color is once transferred from each photosensitive member to an intermediate transfer belt as an image receiver member, and then transferred to a sheet by one operation.

Further, the invention is not limited to a tandem color laser printer, and may be applied to a four-cycle color laser printer that forms toner images of each color on one photosensitive drum common to developing units of each color successively, transfers and overlays the toner images one over the other onto an image receiver member such as a sheet or an intermediate transfer belt, and then transfers them as a single unit onto a print sheet Further, the invention is not limited to a laser printer, and may be applied to an LED printer in which exposure is made by LEDs (light emitting diodes).

The following is a description of why the image forming apparatus can efficiently prevent the increment of the amount of electrostatic charge in a developing agent on the image receiver member.

To reduce the increment in the amount of electrostatic charge in the developing agent image on the image receiver member, it is preferable to set as low as possible, the transfer bias for transferring the developing agent image from the photosensitive member to the image receiver member. However, if the transfer bias is set too low, such means will wrongly affect the transferability of the developing agent image from the photosensitive member to the image receiver member. Thus, it is preferable to use a developing agent having high transfer efficiency and set the transfer bias as low as possible within a range where a preferable transferability can be maintained. However, the transfer efficiency of the developing agent often varies according to coloring agents added to the developing agents of different colors, and it is conceivable to set a transfer bias in accordance with the transfer efficiency of a developing agent of each color. In this case, it is preferable that the transfer bias for transferring a developing agent image to be transferred earlier on the image receiver member is set lower, because the amount of electric static charge is likely to increase in the developing agent image transferred earlier on the image receiver member. Thus, as in the image forming apparatus, the increment in the amount of electrostatic charge of the developing agent image on the image receiver member can be effectively prevented by transferring the developing agent images onto the image receiver member earlier in the order of higher transfer efficiencies of the developing agents, and by setting the transfer bias lower as the developing agent image having higher transfer efficiency is transferred.

As a concrete example, the following describes relationships between the transferability and transferring order of developing agents of different colors to the image river member in the image forming apparatus. In the following description, T1, T2, T3 and T4 stand for transfer efficiencies of the developing agents and their magnitude relation is T1>T2>T3>T4.

EXAMPLE 1

T1 is transferability for yellow developing agent, T2 for magenta developing agent, T3 for cyan developing agent, and T4 for black developing agent. The developing agent images are transferred onto the image receiver member in the order of yellow, magenta, cyan, and black.

EXAMPLE 2

T1 is transferability for yellow and magenta developing agents, T2 for cyan developing agent, and T3 for black developing agent. The developing agent images are transferred onto the image receiver member in the order of yellow, magenta, cyan and black. The order of yellow and magenta can be changed.

EXAMPLE 3

T1 is transferability for yellow, magenta and cyan developing agents, and T2 for black developing agent. The developing agent images are transferred onto the image receiver member in the order of yellow, magenta, cyan and black. The order of yellow, magenta and cyan can be changed.

EXAMPLE 4

T1 is transferability for yellow and magenta developing agents, and T2 for cyan and black developing agents. The developing agent images are transferred onto the image receiver member in the order of yellow, magenta, cyan, and black. The order of yellow and magenta and the order of cyan and black can be changed.

In the case of Example 1, transfer biases Vy, Vm, Vc, Vk for transferring developing agent images of yellow, magenta, cyan and black respectively, are set higher in this order (Vy<Vm<Vc<Vk). Even when the transfer efficiencies are different, there may be actually little difference between them. For example, in the case where T1 is nearly equal to T2 in Example 1, it may be regarded as "Vy−Vm". Even in this case, there is no possibility that a transfer bias for transferring a developing agent image earlier to be transferred on the image receiver member is set higher than that for a developing agent image lathe to be transferred on the image receiver member, and advantageous effects of the invention can be obtained.

It is known that higher flowability makes the transferability more improved For example, it is disclosed in "Polymerized toner/Functional control of micron-size particles" written by Noboru YANAGIDA, Kazunori SHIGEMORI and Jun HASEGA WA, in the special issue "Organic/non-organic hybrid materials" of Kobunshi Ronbun Vol. 57 No. 6, pp 336–345 (2000). The flowability of the developing agent of each color can be compare using a commercially-available measuring apparatus. For example, as disclosed in the above technical literature, a sieve with a mesh size of 250 μm is placed on Hosokawa Micron Powder Characteristics Tester, model PT-N, a developing agent of 20 g is placed thereon and shifted through the sieve, thereby the flowability of the developing agent can be calculated as an amount of the developing agent shifted through the sieve for one minute by gram.

What is claimed is:

1. An image forming apparatus, comprising:

a plurality of developing devices, each of which contains a developing agent of a single color therein;

a photosensitive member that rotates in a peripheral direction;

a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically, wherein a developing agent image formed of developing agent having a higher transfer efficiency is transferred earlier than a developing agent image formed of developing agent having a lower transfer efficiency onto the image receiver member, and a transfer bias for transferring the developing agent images from the photosensitive member to the image receiver member is set lower for the developing agent image formed of the developing agent having the higher transfer efficiency.

2. The image forming apparatus according to claim 1, wherein the photosensitive member comprises a plurality of photosensitive members corresponding to each color of the developing agent, the latent image formed by the latent image forming device is developed into the visible image on each of the photosensitive members using the developing agent supplied by each of the developing devices, the developing agent images of each color making the visible image are sequentially transferred and overlaid one over another onto the image receiver member, and a multi-color developing image is formed on the image receiver member.

3. The image forming apparatus according to claim 2, wherein the developing devices collect the developing agent remaining on each of the photosensitive members after the developing agent images on the photosensitive members are transferred onto the image receiver member.

4. An image forming apparatus, comprising:

a plurality of developing devices, each of which contains a developing agent of a single color therein;

a photosensitive member that rotates in a peripheral direction;

a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically, wherein a developing agent image formed of a developing agent having a higher flowability is transferred earlier than a developing agent image formed of a developing agent having a lower flowability onto the image receiver member, and a transfer bias for transferring the developing agent images from the photosensitive member to the image receiver member is set lower for the developing agent image formed of the developing agent having the higher flowability.

5. The image forming apparatus according to claim 4, wherein a developing agent image formed of a developing agent of which flowability is improved due to a higher weight ratio of an additive to be added to the developing agent is transferred earlier onto the image receiver member.

6. The image forming apparatus according to claim 5, wherein the additive is an agent that improves flowability.

7. The image forming apparatus according to claim 4, wherein the developing agent includes base particles and various types of additives with particles that vary in size, and an additive with a smallest mean particle size included in the developing agent to be transferred first to the image receiver member has a mean particle size that is smaller than an additive with a smallest mean particle size included in the developing agent to be transferred second or later to the image receiver member.

8. The image forming apparatus according to claim 7, wherein an additive with a smallest mean particle size included in the developing agent to be transferred second to the image receiver member has a mean particle size that is smaller than an additive with a smallest mean particle size included in the developing agent to be transferred third or later to the image receiver member.

9. The image forming apparatus according to claim 8, wherein an additive with a smallest mean particle size included in the developing agent to be transferred third to the image receiver member has a mean particle size that is smaller than an additive with a smallest mean particle size included in the developing agent to be transferred fourth to the image receiver member.

10. The image forming apparatus according to claim 4, wherein a mean particle size of base particles included in the developing agent to be transferred first to the image receiver member is greater than a mean particle size of base particles included in the developing agent to be transferred second or later to the image receiver member.

11. The image forming apparatus according to claim 10, wherein a mean particle size of base particles included in the developing agent to be transferred second to the image receiver member is greater than a mean particle size of base particles included in the developing agent to be transferred third or later to the image receiver member.

12. The image forming apparatus according to claim 11, wherein a mean particle size of base particles included in the developing agent to be transferred third to the image receiver member is greater than a mean particle size of base particles included in the developing agent to be transferred fourth to the image receiver member.

13. The image forming apparatus according to claim 4, wherein a ratio of a mean volume-average particle size to a mean number-average particle size of base particles included in the developing agent to be transferred first to the image receiver member is smaller than a ratio of a mean volume-average particle size to a mean number-average particle size of base particles included in the developing agent to be transferred second or later to the image receiver member.

14. The image forming apparatus according to claim 13, wherein a ratio of a mean volume-average particle size to a mean number-average particle size of base particles included in the developing agent to be transferred second to the image receiver member is smaller than a ratio of a mean volume-average particle size to a mean number-average particle size of base particles included in the developing agent to be transferred third or later to the image receiver member.

15. The image forming apparatus according to claim 14, wherein a ratio of a mean volume-average particle size to a mean number-average particle size of base particles included in the developing agent to be transferred third to the image receiver member is smaller than a ratio of a mean volume-average particle size to a mean number-average particle size of base particles included in the developing agent to be transferred fourth to the image receiver member.

16. The image forming apparatus according to claim 4, wherein a mean roundness of base particles included in the developing agent to be transferred first to the image receiver member is greater than a mean roundness of base particles included in the developing agent to be transferred second or later to the image receiver member.

17. The image forming apparatus according to claim 16, wherein a mean roundness of base particles included in the developing agent to be transferred second to the image receiver member is greater than a mean roundness of base particles included in the developing agent to be transferred third or later to the image receiver member.

18. The image forming apparatus according to claim 17, wherein a mean roundness of base particles included in the developing agent to be transferred third to the image receiver member is greater than a mean roundness of base particles included in the developing agent to be transferred fourth to the image receiver member.

19. The image forming apparatus according to claim 4, wherein a specific surface area of an additive having a smallest particle size included in the developing agent to be transferred first to the image receiver member is greater than a specific surface area of an additive having a smallest particle size included in the developing agent to be transferred second or later to the image receiver member.

20. The image forming apparatus according to claim 19, wherein a specific surface area of an additive having a smallest particle size included in the developing agent to be transferred second to the image receiver member is greater than a specific surface area of an additive having a smallest particle size included in the developing agent to be transferred third or later to the image receiver member.

21. The image forming apparatus according to claim 20, wherein a specific surface area of an additive having a smallest particle size included in the developing agent to be transferred third to the image receiver member is greater than a specific surface area of an additive having a smallest particle size included in the developing agent to be transferred fourth to the image receiver member.

22. An image forming apparatus, comprising:

a plurality of developing devices, each of which contains a developing agent of a single color therein;

a photosensitive member that rotates in a peripheral direction;

a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically, wherein a developing agent image to be transferred first to the image receiver member is formed of a developing agent whose transfer efficiency is higher than that of a developing agent used for a developing agent image to be transferred last, and a transfer bias for transferring the developing agent image to be transferred first on the image receiver member is set lower than a transfer bias for transferring the developing agent image to be transferred last on the image receiver member.

23. An image forming apparatus, comprising:

a plurality of developing devices, each of which contains a developing agent of a single color therein;

a photosensitive member that rotates in a peripheral direction;

a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically, wherein a developing agent image to be transferred first to the image receiver member is formed of a developing agent whose flowability is higher than that of a developing agent used for a developing agent image to be transferred last, and a transfer bias for transferring the developing agent image to be transferred first on the image receiver member is set lower than a transfer bias for transferring the developing agent image to be transferred last on the image receiver member.

24. An image forming apparatus, comprising:

a plurality of developing devices, each of which contains a developing agent of a single color therein;

a photosensitive member that rotates in a peripheral direction;

a latent image forming device that forms a latent image on the photosensitive member, the latent image being developed into a visible image on the photosensitive member, the visible image being made of developing agent images of each color using the developing agent of the single color supplied by each of the developing devices; and an image receiver member that contacts the photosensitive member and receives the developing agent images of each color formed on the photosensitive member sequentially and electrically, wherein at least two developing agent images are formed of developing agent, each developing agent has a flowability and the at least two developing agent images are formed sequentially according to the flowability of the developing agent, and a transfer bias for transferring developing agent images from the photosensitive member to the image receiver member is set lower for the first developing agent image that is transferred than a transfer bias for transferring a second developing agent image.

* * * * *